United States Patent [19]

Cranford

[11] Patent Number: 4,867,592

[45] Date of Patent: Sep. 19, 1989

[54] KEYSTROKE ALIGNING SYSTEM AND MARGIN INDICATOR FOR TYPEWRITERS AND COMPUTER PRINTERS

[75] Inventor: Robert F. Cranford, Encino, Calif.

[73] Assignee: Aline-A-Lite, Inc., Los Angeles, Calif.

[21] Appl. No.: 931,521

[22] Filed: Nov. 17, 1986

[51] Int. Cl.[4] ..... B41J 29/42

[52] U.S. Cl. ..... 400/709; 400/711

[58] Field of Search ..... 400/704, 708, 711, 632.1, 400/633.2, 706, 707, 709.2

[56] References Cited

U.S. PATENT DOCUMENTS

| | | | |
|---|---|---|---|
| 2,558,147 | 6/1951 | Nicely | 400/709 |
| 2,873,013 | 2/1959 | Thiene et al. | 400/23 |
| 4,339,208 | 7/1982 | Biedermann | 400/711 X |

FOREIGN PATENT DOCUMENTS

| | | | |
|---|---|---|---|
| 1812168 | 8/1970 | Fed. Rep. of Germany | 400/708 |
| 3022724 | 1/1982 | Fed. Rep. of Germany | 400/708 |
| 1090636 | 4/1955 | France | 400/708 |
| 5975 | 1/1986 | Japan | 400/709 |

OTHER PUBLICATIONS

"Fibre-Optic Object Sensor" by Bealle, IBM Technical Disclosure Bulletin, vol. 23, No. 5, Sep. 1980.

*Primary Examiner*—Edgar S. Burr
*Assistant Examiner*—Moshe I. Cohen
*Attorney, Agent, or Firm*—Hadd S. Lane

[57] ABSTRACT

An optical method for alignment of paper when making corrections and additions to previously typed or printed sheets is described. A light spot is projected which indicates the exact point of type impact on the sheet. The paper can then be moved until the spot falls onto the desired area. The system can also be used for margin and end-of-page signalling.

7 Claims, 1 Drawing Sheet

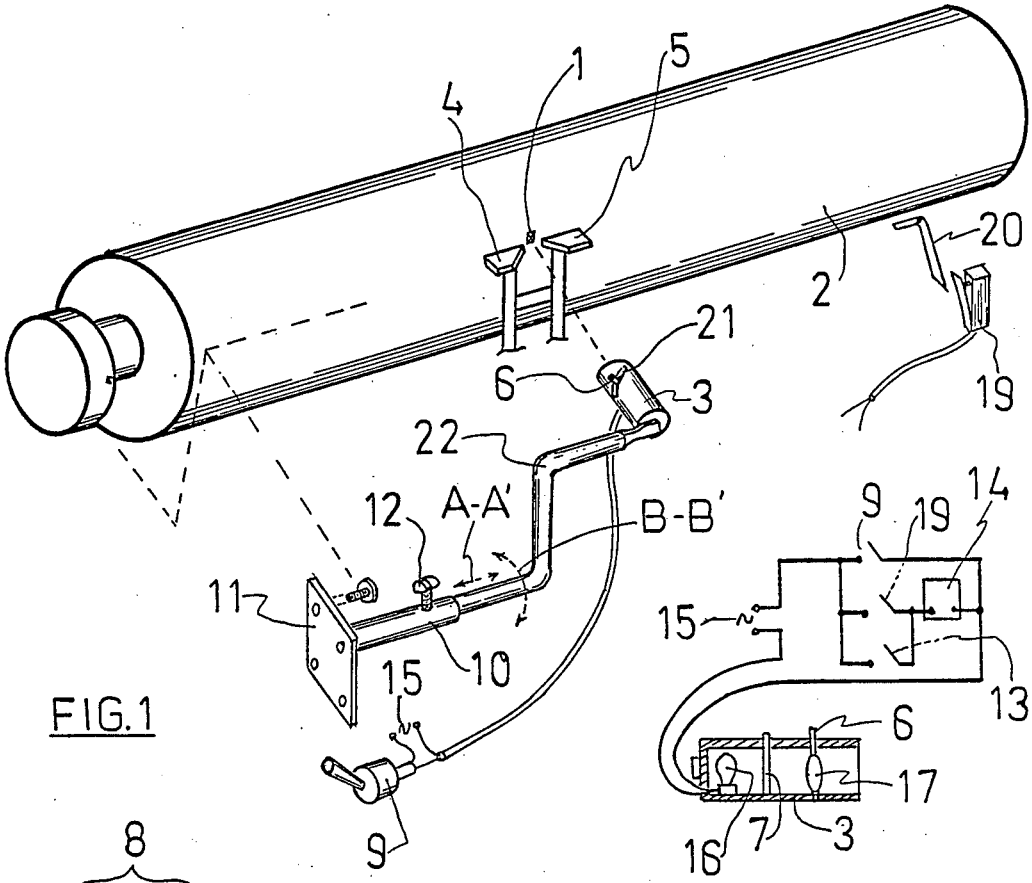
FIG.1
FIG. 2
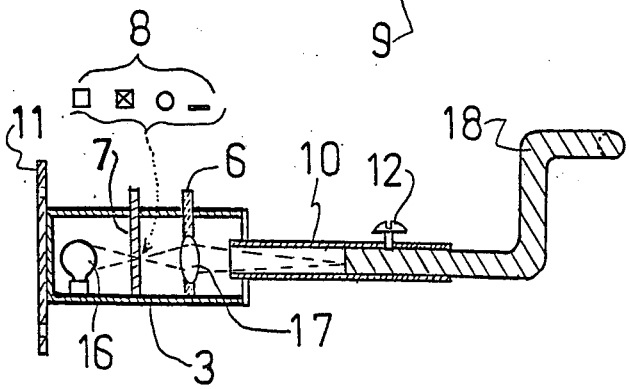
FIG. 3

KEYSTROKE ALIGNING SYSTEM AND MARGIN INDICATOR FOR TYPEWRITERS AND COMPUTER PRINTERS

BACKGROUND

The present invention relates to an apparatus to aid in the aligning of paper in typewriters and similar machines so that a keystroke will fall within a desired space on a sheet of paper. It often happens that paper in a typewriter will slip out of alignment with previous lines during erasures or when it is removed and reinserted in the machine. It is then desired that both letter and line space be restored to the original so that additions and corrections will coincide accurately with the previous material. In many cases typing is done on printed forms having boxes to check or preprinted lines on which to enter replies to questions. The adjustment of the paper is awkward and often requires several attempts because the line guide provided for this purpose is interrupted by an aperture at the exact point where alignment is needed. The aperture is necessary because space must be provided for the type face to strike the paper.

This problem was recognized early in the development of typewriters and prior art teaches some of the methods devised for overcoming it. In Nicely (U.S. Pat. No. 2,588,147), for example, a three hole plate is mounted so that it can swing over the aperture. When the two outside holes are aligned with previously typed letters, the central hole will now indicate where the key will strike. The carriage and line spacers are released and the paper moved so that the central hole is over the area on which the correction is to start. The plate is now swung away, the spacers returned to normal and the work resumed. In an earlier patent, Baron (U.S. Pat. No. 1,023,796) uses a flexible wire to partially bridge the aperture and to point down to the striking space of any key. When the paper is adjusted so that the spot pointed to by the end of the wire is aligned with an existing letter, the paper can then be moved to the desired open area. The flexible wire encounters part of the key bar during the end of the stroke, bends and then acts as a repulsing spring to return the key bar to its rest position. Other mechanical devices for alignment are described in Dobson (U.S. Pat. No. 1,582,906) and Foothorap (U.S. Pat. No. 1,383,096).

Although all of these devices are applicable to the problem of alignment, none is convenient or rapidly carried out.

Another problem which commonly occurs in typing is that of the margin signal. The presently used bell is often ignored by some typists which then leads to uneven right hand margins.

It is a first objective of the present invention to provide a non-contacting, readily adjusted and easily used line and column alignment device to permit corrections and additions to be made to existing typing and facilitate typing on preprinted forms.

It is a second objective of the present invention to permit alignment in computer printers as well as typewriters.

It is a third objective of the present invention to reinforce presently used margin signals to better gain the typist's attention.

DESCRIPTION OF THE DRAWINGS

FIG. 1 is a perspective view of the invention as it would be installed on a typewriter showing an image emitting head, an adjusting mechanism, a mounting arrangement and part of the electrical circuit.

FIG. 2 is a cross sectional view of the emitting head and a schematic of the electrical circuit.

FIG. 3 is a cross sectional view of a second embodiment of the emitting head.

DESCRIPTION OF THE INVENTION

The invention as shown in FIGS. 1, 2 and 3 is based on the observation that a well defined spot of light attracts attention, is easily discerned against a dim background and can be used for precise alignment of physical objects with one another. In the embodiment of the invention shown in FIG. 1 a focussed light spot 1 appears between the type bar guides 4 and 5 and falls on any sheet of paper inserted in typing position against the cylindrical platen 2. The spot of light originates from the emitting head 3 which is shown in cross section in FIG. 2. Within the emitting head is a light source 16 which can be a miniature incandescent bulb of the conventional or halide type, a light emitting diode or a laser emitting diode. The light passes through a design-carrying slide 7 and is focussed by the lens 17 onto the paper in the typewriter. The lever 6 attached to the lens mounting is moveable in the helical slot 21 and can be used to move the lens axially in the emitting head 3. A supporting member 22 is rigidly attached to the end of the emitting head and is rotatable and slidable in the tube 10 as shown in FIG. 1. By the use of this arrangement motion of a circuit interrupter or emitting head in the directions A—A' and B—B' can be obtained.

When the light spot is accurately set between the guides 4 and 5, the position is fixed by means of the set screw 12. Tube 10 is rigidly joined to the bracket 11 which is mounted to the inside of the typewriter. The light source 16 is energized by a power supply at 15 through the switch 9.

The switches 13 and 19 (FIG. 2) are in parallel and connect the flasher 14 in series with the light source 16. Switch 19 can be a leaf operated microswitch mounted on the right edge of the typewriter and triggered by lever 20 which is adjustabley positioned on the carriage. When the carriage approaches the margin, the flasher 14 is activated and the typist's attention is attracted by the pusling light spot. This reinforces the bell signal.

In its use as an aid in paper alignment, the emitting head of the invention is positioned so that the light spot 1 coincides with the exact strike spot of any key on the platen. This requires a focus adjustment by use of the lever 6 and a final tightening of the set screw 12. Once made this adjustment will be sufficient for a relatively long time unless the typewriter is severely jarred or the light source 16 needs to be replaced. When a sheet with typing requires alignment, switch 9 is first turned on to produce light spot 1. The paper release mechanism is actuated to permit the paper to be moved until a typed character near the point of correction is exactly under the light spot. The release levers are then returned to their off positions. The normal carriage rotation and space bar can then be used to position the paper to the exact area for the first new keystroke. Switch 9 is now turned off.

To make use of the margin signal, the lever 20 is adjusted for the desired right hand margin. The actuation of switch 19 at the end of each line will produce a bright, flashing of the light spot 1 which will attract the attention of the typist.

A second switch 13 may be actuated by a geared roller device which would close the circuit after the platen had made the number of revolutions equivalent to an 11 or 14 inch sheet of paper. The flashing light would then constitute an end-of-page signal.

In a second embodiment of the invention shown in FIG. 3, the emitting head 3 is directly connected by bracket 11 to the inside of the typewriter. The light from source 16 is transmitted to the paper by means of the rigid fiber optic rod 18. Adjustment in the A—A' and B—B' directions is made in the same way as in the first embodiment and locked by the set screw 12.

Patterns for the light spot on slide 7 are shown at 8.

The invention is effective on both the moving platen style of machine as described above and on the moving typeface arrangements such as the ball font and the daisy wheel. In the latter cases the light emitting head would be mounted on the moving type-face structure.

What is claimed is:

1. A combined non-contacting alignment guide and paper margin indicating device for use with typewriters, computers and similar machines having a type carrying frame, comprising:

a. an electrically energized emitting head containing a light source, focusing means, and a pattern projecting means;

b. a mounting for said emitting head to be rigidly fixed to the frame of said machine whereby said pattern may be projected onto the paper being typed to indicate accurately the point of impact of a type face and is subsequently used to align said paper with previous printing to produce uniform alignment with subsequent keystrokes;

c. a paper carrying platen movable relative to said head;

d. electrical circuit-closing means responsive to the movement of said platen to a position indicating a selected margin of said paper;

e. an electric power supply connected to said light source through said circuit-closing means;

f. a further manually operated switch connecting said light source to said power supply;

g. whereby said manual switch may operate said light source only when said alignment is desired, and the closing means operates only when said platen has moved to said position of a selected margin.

2. The combined device of claim 1 wherein said mounting is adjustably secured to said frame, to ensure the accuracy of the pattern to the said point of impact of a type face.

3. The combined device of claim 1 wherein said circuit-closing means is a switch actuated by the carriage when at the desired side margin position, thus constituting an end-of-the-line indicator.

4. The combined device of claim 3 wherein the circuit for the last mentioned switch also includes a cyclic circuit interrupter, to provide a flashing light as the end-of-line indicator.

5. The combined device of claim 1 wherein the selected margin is the bottom margin, thus providing an end-of-page indicator.

6. The combined device of claim 3 wherein a further circuit-closing means responds to a desired bottom margin and connects the power source to the light source, thus providing a combined optical alignment, side margin, and end-of-page indicator.

7. The combined device of claim 1 wherein said head can be mounted inside the machine, and said pattern is projected onto the surface of the paper by means of a fiber optic rod.

* * * * *